US007334792B1

(12) United States Patent
Bermann

(10) Patent No.: US 7,334,792 B1
(45) Date of Patent: Feb. 26, 2008

(54) DICE GAME

(76) Inventor: Ronnie J. Bermann, 3505 Sage Rd., Unit No. 2402, Houston, TX (US) 77056

( * ) Notice: Subject to any disclaimer, the term of this patent is extended or adjusted under 35 U.S.C. 154(b) by 0 days.

(21) Appl. No.: 11/562,365

(22) Filed: Nov. 21, 2006

(51) Int. Cl.
*A63F 9/04* (2006.01)

(52) U.S. Cl. ..... 273/146

(58) Field of Classification Search ..... None
See application file for complete search history.

(56) References Cited

U.S. PATENT DOCUMENTS

| | | | | |
|---|---|---|---|---|
| 4,469,329 | A * | 9/1984 | Guyer | 273/146 |
| 4,648,602 | A * | 3/1987 | Maroney | 273/146 |
| 4,834,386 | A * | 5/1989 | Rosenthal et al. | 273/146 |
| 4,930,780 | A * | 6/1990 | Goodman et al. | 273/146 |
| 5,364,101 | A * | 11/1994 | Spooner et al. | 273/146 |
| 5,405,145 | A * | 4/1995 | Jones et al. | 273/146 |
| 5,413,351 | A * | 5/1995 | Franklin | 273/274 |
| 5,605,331 | A | 2/1997 | Boe | |
| 5,649,704 | A * | 7/1997 | Dobbin | 273/268 |
| 6,273,423 | B1 | 8/2001 | Promutico | |
| 6,854,732 | B2 | 2/2005 | Moody | |
| 2002/0190465 | A1 | 12/2002 | Ibrahim et al. | |
| 2003/0062672 | A1 * | 4/2003 | Sloper | 273/146 |
| 2005/0046107 | A1 | 3/2005 | Guyer | |

* cited by examiner

*Primary Examiner*—Eugene Kim
*Assistant Examiner*—Dolores R. Collins
(74) *Attorney, Agent, or Firm*—Egbert Law Offices

(57) ABSTRACT

A method of playing a dice game by a plurality of players using a plurality of dies includes the steps of rolling the dice so as to as to display dice values, assigning a point value corresponding to some of the dice, removing the dies that have an assigned point value, tallying a total value of the point values of the removed dies, re-rolling the remaining dies so as to display additional dice values, removing the dies that have the assigned point value, tallying the total point value of the removed dies, repeating the steps alternately between players until a final point value is achieved.

15 Claims, No Drawings

DICE GAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to relates to dice games. More particularly, the present invention relates to dice games whereby a plurality of players alternately roll the dice in a particular order so as to achieve a final point total.

2. Description of Related Art Including Information Disclosed Under 37 CFR 1.97 and 37 CFR 1.98.

Dice games are very popular. Throughout history, people have played dice games for entertainment and for gambling purposes. Typically, dice will display a dice value on each of the faces of the dice. Where the die consists of a six sides, each of the six sides will have a dice value selected between the numerals 1 and 6. Typically, each of the faces of the dice will display a dot or a plurality of dots that correspond to such a dice value.

In certain dice games, a total value of a plurality of dies is totaled. For example, in the game of craps, efforts are made to roll the dice so that a pair of dice will have the dice values tallied so as to equal a desired point total. The point total will then correspond to an indicator that is representative of a monetary value.

In the past, various patents have issued and patent publications published relating to such dice games.

U.S. Pat. No. 6,854,732 issued on Feb. 15, 2005 to E. W. Moody, describes a dice game that utilizes six dies. Each player makes a wager on the sum total of the six dies that would result from a single roll. A plurality of sum total groups are pre-established and a player makes a wager on one or more of the sum total groups that can be achieved from a single roll of the six dice.

U.S. Pat. No. 6,273,423 issued on Aug. 14, 2001 to R. R. Promutico, shows a game of chance that uses six dies. There are two sets of playing pieces consisting of three dies each. One set is visibly distinguishable from the second set. All bets are placed on the board before the first set of dice is thrown. The payoffs for each bet are set by the house. Players use the two sets of dice in sequence wherein winning bets are related to poker hands.

U.S. Pat. No. 5,605,331, issued to M. Boe on Feb. 26, 1997, describes a dice game in which a lead player and all succeeding players each have a turn in each round of play. The lead player rolls eight dice in an attempt to get the greatest number of 6's, 5's, 4's, 3's, 2's, or 1's. In any turn, the lead player may roll up to five of the dice twice after the initial roll in an effort to add to the number of 6's, 5's, 4's, 3's, 2's, or 1's rolled in the first roll. A predetermined value is assigned to the result of the lead player's turn. The value may be indicated upon the game board by placing a colored marker peg at the appropriate value on the game board. Subsequent players attempt to achieve a result of a higher predetermined value than that achieved by the lead player in the same number of rolls used by the lead player. If one or more subsequent players achieve a result higher than that of the lead player, the subsequent player with the highest result becomes the lead player and begins a new round of play.

U.S. Pat. No. 4,469,329, issued on September 1984 to R. W. Guyer, teaches a game apparatus that comprises a plurality of dice-like playing pieces and a container having a top and a bottom. The bottom of the container is formed in a cup shape for use in shaking and casting the playing pieces upon a playing surface. The top of the container has a plurality of recesses. Each recess is formed to retain at least one of the playing pieces during play.

U.S. Patent Publication No. 2005/0046107, published on Mar. 3, 2005 to R. W. Guyer, relates to a method of playing a game of chance so as to incorporate an element of risk by rewarding a player for corresponding master and score value designations. One master die is used and a plurality of scoring dice are used. The master die has a plurality of master sides. Each master side bears a master value designation thereon. Each scoring die has a plurality of scoring sides with each scoring side of each scoring die bearing a score value designation corresponding to one of the master value designations. During a turn, the player shakes the master die and the plurality of scoring dice to obtain an upwardly facing master side and a plurality of upwardly facing scoring sides. The player's shake score is then calculated based on the number of upwardly facing scoring sides with score value designations which correspond to the master value designation on the upwardly facing master side.

U.S. Patent Publication No. 2002/0190465, published on Dec. 19, 2002 to Ibrahim et al., teaches a betting game that uses dice. The winner of a given bet is determined by the numbers which appear on the faces of two thrown die. The individual throwing the dice is deemed the winner of a bet if a particular combination of indicia are found to be facing upward on the dice after they have been cast. Certain other combinations of indicia will result in the player winning the bet. Other combinations of indicia result in a higher payout ratio or no winners with a transfer of the dice to another shooter.

It is an object of the present invention to provide a dice game which is entertaining.

It is another object of the present invention to provide a dice game which is easy to understand and easy to play.

It is a further object of the present invention to provide a dice game that offers athrill to those that play the game.

It is still a further object of the present invention to provide a dice game which is relatively inexpensive.

It is a further object of the present invention to provide a dice game which is adaptable to gambling activities.

These and other objects and advantages of the present invention will become apparent from a reading of the attached specification and appended claims.

BRIEF SUMMARY OF THE INVENTION

The present invention is a method of playing a dice game by a plurality of players using a plurality of dies comprising the steps of: (1) rolling the plurality of dies by a first player of a plurality of players such that the plurality of dies displays a plurality of dice values; (2) assigning a point value corresponding to at least some of the plurality of dice values; (3) removing the dies that have an assigned point value; (4) tallying a total value of the point values of the remaining dies; (5) re-rolling the remaining dies so as to display another plurality of dice values; (6) removing the dies of the remaining dies that have the assigned point value; (7) tallying another total value of the point value of the removed remaining dies; (8) entering the game if the total value of the removed remaining dies equals or exceeds a preassigned value; (9) repeating steps (1)-(8) by the second player of the plurality of players; (10) repeating steps (1)-(7) by the first player if the total value of the removed dies and of the removed remaining dies exceeds the preassigned value; (11) repeating steps (1)-(7) by the second player if the total value of the removed dies and of the removed remaining dies exceed the preassigned value; and (12) alternating steps (10) and (11) until a final point value is achieved by one of the first and second players.

In the present invention, the plurality of dies includes six dies. Each of the plurality of dice values is a number between "1" and "6", inclusive. The assigned point value is 100 for a dice value of either "2" or "6". The assigned point value is 400 for three dies having a dice value of "1", is 400 for three dies having a dice value of "2", is 400 for three dies having a dice value of "3", is 400 for three dies having a dice value of "4", is 500 for three dies having a dice value of "5", and is 600 for three dies having a dice value of "6". The method assigned point value is 1000 if four dies have identical dice values, is 2000 if five dies have identical dice values, and is 3000 if six dies have identical dice values. The assigned point value is 2500 if the dice values are consecutive among. The six dies. The assigned point value is 1500 if three pairs of the six dies have identical dice values and is 2500 if two sets of three dies have identical dice values. The assigned point value is equal to the final point value if all of the six dies has dice values of either "1" or "2", or a combination of both.

The remaining dies are those dies having a dice value of neither "2" or "6". In the preferred embodiment of the present invention, the total value is 600.

The player loses a turn if neither of the re-rolled remaining dies have the assigned point value. The total value is lost if the turn is lost. The plurality of dies are rolled again if all of the rolled or re-rolled dies have the assigned point value. In the preferred embodiment, the final point value is 15,000.

The other player rolls the plurality of dies again when one of the players achieves the final point value.

If the game is to be used in a gambling environment, a monetary value can be to the assigned point value. A verbal indicia can be assigned to the loss of a turn, such as the coined word "pharcle" or "pharc".

DETAILED DESCRIPTION OF THE INVENTION

The present invention is a dice game that includes a plurality of dice played by a plurality of players. Each of the dies of the plurality of dice is a six-sided die. Each of the sides of the dice has a separate numerical value. In particular, these numerical values are "1", "2", "3", "4", "5" and "6". The numerical value that appears at the top of the side of the die after the die is thrown is the numerical value applied in the present game. Typically, the plurality of dies are thrown onto a receiving tray, such as the bottom of a large cigar box. After the dice are thrown, the values appearing on the top sides of they present invention are tallied.

In particular, in the present invention, the first player can be selected in a conventional manner, such as a coin flip or the rolling of single die. When more than two players are playing, then first player can be chosen by rolling a single die by each of the plurality of players. The person starting the game is the player that rolls the highest point value on the single die.

The first player rolls the plurality of dies such that the plurality of dies displays any of a plurality of dice values. A point value is assigned to at least some of the plurality of dice values. The dies that have an assigned point value are removed from the plurality of dies. The total value of the point values of the removed dies is then tallied. The remaining dies are re-rolled so as to display another plurality of dice values. Those dies that are removed that have assigned a point value. Another total value of the point values of the removed remaining dies is then tallied. If the total value of the removed remaining dies equals or exceeds a preassigned value, the first player can enter the game. These steps are then repeated by the second player. Once both of the players enter the game by achieving the total value, then the players will alternate or play sequentially using the similar steps. Ultimately, when the total point value is achieved by one of the players, that player can be the winner. For an example, in an alternating mode, if either of the first player or the second player reaches 600 as the preassigned value or more, than that player can begin to accumulate points. The other player, who has not yet reached 600 as the preassigned value, must reach 600 as the preassigned value before accumulating points.

Specifically, a total of six dies are used in the present dice game. There is an assigned point value of 100 for a dice value of either "2" or "6". There are alternate point values that are also applied in the present game. For example, the assigned point value is 400 where three dies of the plurality of dies have a dice value of "1". The assigned point value is 400 where three dies of the plurality of dies have a dice value of "2". The point value is 400 where three dies of the plurality of dies has a dice value of "3". The assigned point value is 400 where three dies of the plurality of dies has a dice value of "4". The point value is 500 where three dies of the plurality of dies has a dice value of "5". Additionally, the point value is 600 where three dies of the plurality of dies has a dice value of "6". Still further, in the present invention, there are assigned point values for patterns of dice value. For example, the assigned point value is 1000 if four dies have identical dice values. The assigned point value is 2000 if five dies have identical dice values. The assigned point value is 3000 if six dies have identical dice values. The assigned point value is 2500 if the dice value are consecutive if the six dies. The assigned point value is 1500 if three pairs of the six dies have identical dice values. The assigned point value is 2500 if two sets of three dies having a identical dice values. The assigned point value is equal to the final point value if all of the six dies have dice values of either "1" or "2", or a combination of both.

As used in the present invention, the remaining dies are those dies having a dice value of neither "2" or "6". In the preferred embodiment of the present invention, the total value is 600. The player loses a turn if none of the re-rolled remaining dies has an assigned point value. The total value is lost if the turn is lost. The plurality of dies are rolled again if all of the rolled of re-rolled dies have an assigned point value. In the preferred embodiment of the present invention, the final point value is 15,000. Where one player achieves this final point value, the other player has the opportunity to roll the plurality of dies again so as to achieve another final point value. As such, the other player always has the opportunity to win by exceeding the final point value on the remaining last turn. If the other player does not achieve a final point value greater than the first player achieving such a point value, then game is over.

As an example of the present game, the first player rolls the six dice so as to display two "2"'s, two "6"'s, a "3" and a "4". The dies displaying the "2"'s and "6"'s are removed. A total point value of 400 points is achieved. The remaining "3" and "4" are re-rolled. If one of the re-rolled dies displays a "2" or a "6", this re-rolled dice displaying the numeral "2" or "6" is then removed so that the total point value is now 500. The remaining die is then re-rolled. If this remaining die displays either a "2" or a "6" then the player has achieved 600 points and enters the game. If the remaining die does not show either a "2" or a "6", then the first player loses the turn and the total point value achieved. It is then the second player's turn.

As an example, the second player rolls three "1"'s, a "4", a "5" and "6". The three "1"'s are removed for a total point value of 400. The "6" is also removed so that the point value then becomes 500. The remaining dies that display a "4" and a "5" are the re-rolled. The dies are then re-rolled so as to display a "2" and a "3". At this point, the second player has achieved 600 points by the die displaying the numeral "2". As such, the second player has a achieved the 600 point total and can enter the game. The first player can then roll again so as to attempt to enter game in a similar manner.

Since the second player has entered the game and the first player has not yet entered the game, the second player will continue to roll toward the final point value during the time that the first player is still attempting to enter the game. The second player continues to roll in the manner described hereinbefore so as to achieve the various point values. During any turn of a player, if the player makes a roll and a re-roll where no point values are achieved, then the turn is lost and the point values achieved up to that point in time are lost for that turn. The total values achieved from previous turns, once the player has entered the game, remain with such player. When a player loses a turn by failing to achieve the a point value during the turn, then a verbal indicia is applied to that turn, such as a "pharcle" or "pharc". This provides an entertainment value during the game.

Once both players have entered the game, then the first player and the second player will alternate during the rolling of the plurality of dies. They will go back and forth until the tallied point value approaches 15,000. In the event that the player rolls all six dies in which each has an assigned point value, then the player gets a new turn. The point value achieved by all six dies having an assigned point value will be tallied to the player's favor. The player then gets an additional turn in which to build on his or her previous point value. Additionally, for example, if the player rolls dice showing two "2"'s and one "6", the player will have a point value of 300 points. The player will also have three remaining dies. When the player re-rolls the three remaining dies, if all three remaining dies display a dice value of "2" or "6", then the player will receive an additional 300 points so as to make the total 600. Since all of the dies have assigned point values, then the player will get a new turn.

The bonus values associated with having unique series or combinations of dice values is only achieved during the first roll during a turn. If, for example, the three dies that are re-rolled are identical or consecutive, then bonus value is not achieved by such a pattern.

A unique aspect of the present dice game is the strategy employed where one player has relatively large lead. When one of the players has a large lead, then the other player is willing to risk a potential loss of turn by continuing to roll the remaining dies, even though the odds are against such a player. For example, if a losing player rolls five dies that have assigned point values the player may choose, at risk, to roll the remaining single die in an effort to achieve an additional assigned point value and to gain an additional turn. If the player fails to roll an assigned point value then, of course, the player loses the turn and loses the accumulated point value during that turn.

Another unique aspect of the present dice game is the ability to win the game even though one player is very far behind. As was stated previously, if the six dies are rolled and all six dies display either a 1 or a 2, or a combination of both, then the player immediately receives the final point value of 15,000. This is a relatively rare event, but does keep the interest of the player that is very far behind in the game.

The dice game of the present invention can be utilized by more than two players. If four players play the present dice game, then each player takes a sequential turn following a previous player. As such, when the first player finishes his or her turn, then the second player begins. Once the second player loses his or her turn, or achieves a desired point value, then it is the third player's turn. Once the third player achieves a desired point value or loses his or her turn, then the fourth player begins play.

Throughout each of the turns associated with the dice game of the present invention, it is the player's choice whether to roll the remaining dies. For example, if a player rolls three "3"'s, a "4" and two "5"'s, then the player receives a total point value of 400. It is then the player's option (after entering the game) as to whether to roll the remaining three dies. If the player chooses to roll the remaining dies, then it is the players risk of possibly losing the 400 points if none of the three remaining dies has an assigned point value. A conservative player will simply pass the turn to the next player and keep the 400 points. A player willing to assume more risk will choose to risk the 400 point in an effort to achieve more points or an additional turn.

If the dice game of the present invention is desired for gambling activities, then a dollar value can be assigned to the assigned point values. For example, if the game is played for a dollar per point, then if one player scores 15,000 points and the other player achieves 13,500 points, then the second player will owe the first player $1500. Lesser dollar values can also be used with the present invention.

The foregoing disclosure and description of the invention is illustrative and explanatory thereof. Various changes in the details of the described method may be made within the scope of the appended claims without departing from the true spirit of the invention. The present invention should only be limited by the following claims and their legal equivalents.

I claim:

1. A method of playing a dice game by a plurality of players using a plurality of dies comprising:

(1) assigning a total point value and a final point value;

(2) assigning at least one point value corresponding to at least one of a plurality of sides of said plurality of dies;

(3) entering a first stage of said game by rolling said plurality of dies by a first player of said plurality of players such that said plurality of dies displays a first plurality of dice values;

(4) tallying a first total of the point values of said first plurality of dice values having the point values;

(5) removing any dice having the point values in (4) leaving a first plurality of remaining dies;

(6) re-rolling said first plurality of remaining dies so as to display a second plurality of dice values;

(7) tallying a second total of the point values of said second plurality of dice values having the point values;

(8) adding said first total to said second total so as to create a first sum;

(9) repeating steps (5)-(7) until no point values are rolled or no dies remain;

(10) repeating steps (3)-(9) by successive players of said plurality of players who have not entered a second stage;

(11) entering said second stage of said game if said first sum is equal to or greater than said total point value by rolling said plurality of dies such that said plurality of dies displays a third plurality of dice values;

(12) tallying a third total of the point values of said third plurality of dice values having the point values;

(13) removing any dies having the point values in (12) leaving a second plurality of remaining dies;

(14) re-rolling said second plurality of remaining dies so as to display a fourth plurality of dice values;

(15) tallying a fourth total of the point values of said fourth plurality of dice values having the point values;

(16) adding said third total to said fourth total so as to create a second sum;

(17) repeating steps (14)-(16) until no point values are rolled;

(18) repeating steps (11)-(17) if all of said dice values have the point values until no point values are rolled;

(19) continuously adding the point values accumulated during said second stage of said game;

(20) repeating steps (11)-(19) by successive players who have entered the second stage of said plurality of players;

(21) losing a turn and any point values accumulated during said turn if no point values are rolled at any time during said turn; and

(22) determining a winner of said game when any player of said plurality of players has said second sum of said third total and said fourth total of the point values equal to or greater than said final point value.

2. The method of claim 1, said plurality of dies being six dice.

3. The method of claim 2, each of said plurality of dice values being a number between 1 and 6 inclusive.

4. The method of claim 3, the assigned point value being 100 for a dice value of either 2 or 6.

5. The method of claim 4, the assigned point value being 400 for three dies having a dice value of 1, being 400 for three dies having a dice value of 2, 400 for three dies having a dice value of 3, being 400 for three dies having a dice value of 4, 500 for three dies having a dice value of 5, and being 600 for three dies having a dice value of 6.

6. The method of claim 5, the assigned point value being 1000 if four dies have identical dice values, being 2000 if five dies have identical dice values, and being 3000 if six dies have identical dice values.

7. The method of claim 5, the assigned point value being 2500 if the dice value are consecutive among the six dies.

8. The method of claim 5, the assigned point value being 1500 if three pairs of the six dies having identical dice values and being 2500 if two sets of three dies having a identical dice values.

9. The method of claim 5, the assigned point value being said final point value of all of the six dies having dice values of either 1 or 2 or a combination of both.

10. The method of claim 4, the remaining dies being those dies having a dice value of neither 2 or 6.

11. The method of claim 4, said total point value being 600.

12. The method of claim 1, the final point value being 15000.

13. The method of claim 1, further comprising:

giving remaining players of said plurality of players a final turn to obtain another sum of said third total and said fourth total of the point values so as to become an ultimate winner of said game and cause said winner to lose.

14. The method of claim 1, further comprising:

assigning a monetary value to the assigned point value.

15. The method of claim 1, further comprising:

assigning a verbal indicia to the loss of the turn which is stated verbally upon a loss of said turn.

* * * * *